US005145534A

United States Patent [19]

Weedaeghe et al.

[11] Patent Number: 5,145,534

[45] Date of Patent: Sep. 8, 1992

[54] FLUIDIZED BED FOR QUENCHING STEEL WIRE AND PROCESS THEREOF

[75] Inventors: Jozef Weedaeghe, Zwevegem; Marcel Corteville, Izegem-Kachtem, both of Belgium

[73] Assignee: N.V. Bekaert S.A., Belgium

[21] Appl. No.: 557,717

[22] Filed: Jul. 26, 1990

[30] Foreign Application Priority Data

Jul. 26, 1989 [DE] Fed. Rep. of Germany ..... 8900809

[51] Int. Cl.[5] ..... C21D 9/567

[52] U.S. Cl. ..... 148/596; 148/630; 266/251; 266/252

[58] Field of Search ..... 148/14, 16, 128, 143, 148/144; 266/251, 252

[56] References Cited

FOREIGN PATENT DOCUMENTS 3226582 1/1984 Fed. Rep. of Germany ..... 266/251

1224483 3/1971 United Kingdom ..... 148/143

*Primary Examiner*—Deborah Yee

[57] ABSTRACT

A fluidized bed is disclosed for the continuous quenching of steel wires. The fluidized bed is provided with an air convection cooler with high cooling capacity. The temperature of the fluidized bed is regulated by means of a cooling air flow. Such a bed is applicable in the patenting operation, in which the carrying gas for a fluidized bed is taken from the exhaust gases of the austenitizing furnace.

17 Claims, 2 Drawing Sheets

FLUIDIZED BED FOR QUENCHING STEEL WIRE AND PROCESS THEREOF

BACKGROUND OF THE INVENTION

The invention relates to a fluidized bed adapted for continuous quenching of steel wires to a temperature of 250° C. at the lowest. As known, a fluidized bed comprises a container that is filled to a certain height with granules that form the fluidized bed. The granules are inert to high temperatures of 1500° C. and more. At the bottom of the granule bed, there is an inlet adapted for blowing a carrying gas upwards into the bed, with an input flow that is as equally as possible distributed over the bottom surface of the bed. Between a minimum and maximum blowing speed, the granules come to whirl up and down and the bed swells up so as to behave like a cooling fluid that can be traversed by the wires without any hindrance. Typical grain materials are silica-, amumina-, or zirconiasand, silicon carbide or ferrosilicon, and typical grain dimensions lie in the range between 0.03 and 0.5 millimeter and typical fluidized bed heights for wire applications lie around 0.3–0.6 meter. The blowing speed into the bed for fluidization thereof depends on the chosen grain type, and typical speeds lie in the range between 0.06 and 0.15 m/sec. In this way the cooling medium receives a heat transmission coefficient towards the wires of the order of 200 to 600 $W/m^2$° K., which already comes near to the coefficient for cooling liquids. With such cooling medium it is then possible to quench steel wires i.e. to cool with a speed of more than 200° C. per second.

In order to be adapted for the treatment of steel wires, the fluidized bed is further provided with the necessary wire guiding and access means to guide the wire in and out the fluidized bed. In general, the fluidized bed will be arranged for simultaneous and continuous treatment of a number of wires (typical quantities are 10 to 50), which pass side by side through the fluidized bed, in the axial direction of the wires. Typical wire thicknesses vary from 1 to 6 millimeter, and typical carbon contents lie in the range from 0.05 to 1%.

Such a fluidized bed has to maintain its quenching temperature. This means that the quantity of heat that enters the bed via the hot wires and that is given off to the cooling fluid, must also be carried off with the same speed from the fluid. In a fluidized bed, this occurs via the carrying gas that is blown in at a comparatively low temperature, that then takes over the heat from the grains, and that then leaves the bed at the top of it at a higher temperature. The temperature of the fluidized bed is kept as a constant value (notwithstanding any disturbances in the traveling speed and entrance temperature of the wires, and other disturbancies) by regulating of the temperature that influences the entrance temperature of the carrying gas, as described in EP 195.473 (publication number). From the same document it is also known to additionally cool the fluidized bed by means of a secondary system of water cooling pipes that are immersed in the fluidized bed, or by means of blowers that blow cooling air above the fluidized bed.

Such a fluidized bed is however limited with respect to its production capacity (i.e. kg of wire treated per second) per square meter of bed surface, so that a large production also needs a comparatively large fluidized bed. The primary cooling by the carrying gas is limited indeed, because the speed of the carrying gas through the bed cannot be forced up above values above 0.15–0.20 m/sec because the grains would then be blown out of the bed. Consequently, the flow input ($m^3$/sec) per square meter of surface (is equal to the speed) has a limit, and the maximum possible difference between entrance and exit temperature of the carrying gas has also a limit that is mainly determined by the imposed quenching temperature. Also the secondary cooling must be limited, because the water pipes cause a disturbance in the fluidization, and if there are too many of them, the fluidized bed appears rapidly to block up and to collapse. When air blow cooling is used above the bed, then the heat drain capacity of the air is too small, and when this air is mixed up with atomized water, then it appears that this causes the upper surface of the bed to cake together.

Moreover, when the production capacity per square meter of bed surface is increased, there is a second problem : the regulability of the fluidized bed temperature. Due to the fact that a larger quantity of steel has to be treated in a smaller bed, larger irregularities in heat input and heat drain must be taken up by a smaller volume, so that there are also large temperature variations that must be taken up by a more powerful and more rapidly reacting regulating system.

It is an object of the invention to provide, with simple means, a fluidized bed with increased production capacity, per square meter of bed surface, and that has an efficient temperature regulating system.

According to the invention, three measures are combined with each other markedly increasing the density of the pipe system (indirect convection cooling), using a pipe system with air instead of water, and transferring the temperature control from the primary to the secondary cooling circuit.

It has been found indeed that the origin of the obstruction and the collapse of the fluidized bed when there are too many water cooling pipes, lies in the residual moistness of the carrying gas that causes condensation against the cooling pipes. This causes a cake-formation around the pipes and this gives the pipes a larger apparent diameter which causes a disturbance in the fluidized bed. From this, it appears that it remains possible to strongly increase the density of the cooling pipes, when care is taken that such condensation is avoided. A possible measure is the use of a very dry carrying gas, but this requires a special preparation of the gas, or else, the choice of the carrying gas is limited. Such gas may, for instance, consist of exhaust gases of a furnace, with a large inherent moistness, and it is often undesirable to be limited in the choice of the carrying gas.

It is now a first measure according to the invention, to sensibly increase the density of the pipes, but then not to send cooling water through the pipes, but ambient air that is sucked in via a ventilator, although air has a smaller cooling capacity than water. However, by the fact that it is air, and not water, that runs through the pipes, the external surface of the pipes do no longer come at the temperature of the cooling water (below 100° C., and, consequently, condensation), but at an intermediate temperature between the temperature of the cooling air (about 40° C. t the exit of the sucking ventilator) and that of the fluidized bed (200° C. or more). There is consequently no longer any condensation of residual moistness and it is possible to pass to a pipe system with much larger density, and which can be fed by a very large flow of cheap ambient air, whereby the lower cooling capacity of the air is largely compensated.

The density of the pipe system of consequently at least such, that its external surface where the cooling by convection of the fluidized bed occurs, takes at least 0.40 $m^2$ per square meter bed surface, and preferably at least 0.80 $m^2$. And it is intended, when in use, to send a nominal air flow through it Y which causes a cooling capacity ($KW/m^2$ bed surface) of the convection cooler that amounts to at least twice, and preferably four times, the cooling capacity of the primary cooling by the carrying gas. The secondary cooling system must not necessarily have the form of a number of pipes, but can also take other forms, in so far as the system is based on indirect convection cooling, i.e. cooling through a separating wall with convection on either side thereof.

Further according to the invention, and as a second measure in combination with the measure above, the control of the temperature of the fluidized bed is transferred from the primary cooling circuit, with the carrying gas, to the secondary cooling circuit, with the indirect convection cooling with air. This is now easily feasible by control of the air flow that can be obtained at cold temperature and without any limit from the ambient air. Flow control of a water cooling system is much more difficult because this is continuously disturbed by steam formation. Due to the fact that according to said first measure, the bulk of the cooling has been transferred from the primary to the secondary circuit, the steering with the secondary cooling, from zero to the nominal cooling capacity, provides a very strong regulating system for the temperature.

The cooling capacity of the convection cooler, fed with air that is sucked in by a ventilator, can further be increased by injecting, in the air stream through the convection cooler, either in the cooler itself or in the supply duct, an atomized liquid, preferably water. Then it is possible to regulate the temperature of the bed by varying the flow, either of the cooling air, or of the liquid injection, or both. In fact, by acting on the injection of an atomized liquid, the specific heat $C_p$ of the cooling air is controlled. This specific heat is at its lowest level when the air is completely dry, but by injection of an atomized liquid, the vaporizing heat for the very small drops power unit of volume is added. In general terms, by varying the flow of the cooling air and/or of the liquid injection, a variation is produced of the product of the flow with the specific heat of the air stream. This product H is called hereinafter the "specific heat $C_p$ (in Joule per $m^3$ and per °C.) multiplied by the flow (in $m^3$ per sec.). H is consequently a magnitude in Watt per ° C.

Accordingly, in more general terms, the convection cooler has an inlet that is connected with an air source, and the specific heat flow H of the air stream through the convention cooler is variable, and the convection cooler comprises a regulator for keeping the fluidized bed temperature at a constant value, by varying said specific heat flow.

Such a regulator will consequently, according to the general principles in control engineering, comprise a feeling device of the temperature of the fluidized bed, that produces a signal that is representative for that temperature, and a comparator, where said temperature is compared with an adjusted desired temperature and where a correction signal is generated that is representative of the observed deviation, to which is possibly added the integral and/or the derivative over the time of such difference (in the well-known) P, PI, PD or PID regulating systems), and a correcting device where said correction signal is transformed into a variation of a magnitude by means of which the temperature is regulated (in this case the flow of air and/or the liquid injection).

Although it is not always necessary to avoid oxidation during quenching, it is often desirable, and sometimes also absolutely necessary to keep the fluidized bed in a non-oxidizing atmosphere. In this case, a conventional non-oxidizing carrying gas is used, and the fluidized bed and the atmosphere above is as much as possible separated from the external atmosphere, for instance by means of a casing around the fluidized bed that is as closed as possible (but having the necessary passages for the carrying gas and the wires). In a cheap and simple way it is then possible to have the carrying gas supplied from a combustion furnace, in which combustion takes place with a small shortage of oxygen, and of which the exhaust gas, before being blown in as a carrying gas, is passed through a cooling device first, in which the gas is cooled down to a temperature not below 120° C. in order to avoid condensation of the water in the exhaust gas. In this case, the system of the invention is extremely well suited, because the temperature variations of this exhaust gas, as a carrying gas, cannot cause much disturbance any more on one hand, the inlet temperature of this gas has no longer to be controlled as a steering factor for the temperature, and on the other hand, there is the strong regulating system in the secondary cooling system that takes up such temperature variations.

The system according to the invention, and in which the fluidized bed is kept in a non-oxidizing atmosphere, and in which the carrying gas comes from a furnace with uncomplete combustion, is extremely adapted for the quenching operation when continuously patenting steel wires. In such process, the wire is firstly continuously passed through an austenitizing furnace, in which the wire is heated up to a temperature ranging between 900° C. and 1050° C., and then, on exit from the austenitizing furnace, is immediately quenched to a temperature ranging from 530° C. to 570° C. Preferably, the exhaust gas of the austenitizing furnace is used. In this case, the maximal heat drain capacity of the carrying gas per $m^2$ of bed surface is limited to about 25 KW. Owing to the presence of the strong secondary convection cooling, it is not necessary to design the bed for maximal cooling, so that a larger freedom exists for the design, and the bed can be designed for a heat drain of 10 to 15 KW per $m^2$ bed surface. The nominal flow of the secondary air cooling is then designed to a value that amounts to more than four times the above value, for instance five times, and in any case more than 50 $KW/m^2$, for instance 75 $KW/m^2$.

The invention will here further be explained by reference to some drawings in which.

Figure 1:
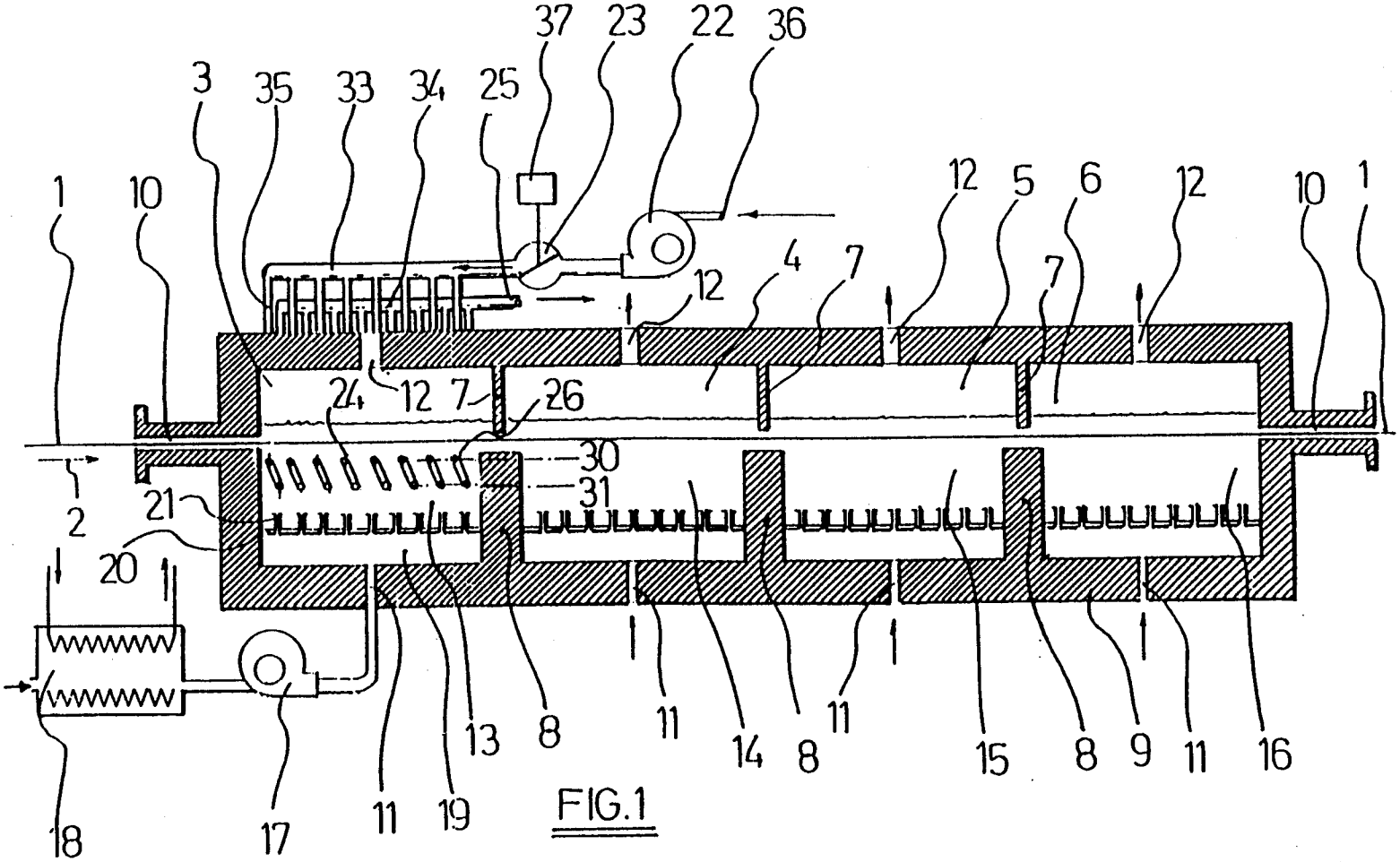
FIG. 1 is a side view of a fluidized bed installation, that comprises a number of fluidized bed chambers, the one immediately subsequent to the other, and in which the first one is designed according to the invention.

FIG. 1 shows a fluidized bed installation that is used for the continuous patenting of a row of steel wires 1, that are traveling side by side in the axial direction of the wires, i.e. in the direction of arrow 2. As the row of steel wires is located in a single plane, perpendicular to the plane of the drawing, only one wire is visible. On FIG. 2 however, which is a partial view from the top, the parallel wires 1 are all visible. The whole of the fluidized bed installation consists of four fluidized bed chambers, 3, 4, 5 and 6 respectively, which are separated from each other by partitions 7 and 8, and which immediately follow the one after the other in downstream direction of the wires.

The first chamber serves for quenching the entering wires, from a temperature inside the austenitizing range (depending on the steel and the desired final characteristics for the wire, this range lies in general between 900° C. and 1050° C.) to the patenting temperature, i.e. the temperature at which the formation of a fine sorbitic structure can start (depending on the steel and the desired final characteristics for the wire, this range lies in general between 530° C. and 570° C.). It is in this first chamber that the quenching has to occur, and where the problems arise that form the basis for the present invention, and consequently, it is this first chamber that is executed according to the invention. The second, third and fourth chamber serve to keep the wire at the patenting temperature during the time, necessary to allow the transformation into sorbite. Here there are no similar problems of heat drain, and consequently they must not be made according to the invention, although this may be so, when the installation has also to serve for other sorts of metallographic transformations, in which two or more chambers are used for quenching the wires. When the installation is used for patenting steel wires, where the second, third and fourth chambers are only used for keeping the wire at a fixed temperature, then the temperature of each chamber can be regulated to a temperature that must not necessarily be the same for the four chambers. For the rapid quench in the first chamber, a rather large temperature difference between the wire and the fluidized bed will be necessary, but for keeping the wire on temperature in the subsequent chambers, the temperature difference can in theory be zero, or the fluidized bed temperature slightly higher, in order to compensate the radiation losses. The temperature in the last three chambers must not necessarily be the patenting temperature to which the wire was quenched in the first chamber, but can diverge therefrom by 30° C. below or above said temperature, depending on the metallographic structure, aimed at for the sorbite. Finally, the length of the chambers may differ, and the number of chambers may vary from 2 to 8 or more.

The whole of the fluidized bed installation is surrounded by a casing 9, that separates the fluidized bed chambers 3 to 6 as much as possible from the external atmosphere, with the exception of the slit openings 10 for the entrance and the exit of the row of wires 1 in and out the inside part of the installation, and of the inlet and outlet openings 11, respectively 12, for the carrying gas of each fluidized bed chamber separately.

The four fluidized bed chambers 3 to 6 each comprise a fluidized bed 13 to 16 respectively, that is filled with grains of aluminum oxide with a grain size ranging between 0.03 and 0.5 mm, and in fluidized state, this bed reaches a height that in general is chosen between 0.3 and 0.6 meter, depending on the desired time for keeping the carrying gas in contact with the fluidized bed grains. The temperature to which the fluidized bed of the first chamber has to be regulated, depends on the required cooling speed of the steel, i.e. on the diameter of the wires and their traveling speed, so that the cooling can penetrate to the core of the wire during the short dwelling time of the wire in the first chamber. For the traveling speeds used in this example, a temperature is taken around the value (500° C.−40d) in which d is the diameter of the wire in mm.

The fluidized bed of the first chamber according to this example has a length, in the direction of the wires, of 1.10 m and a width of 1 meter, and the maximal number of wires that can be guided through this fluidized bed depends on the maximum heat drain capacity of the fluidized bed and on the diameter of the wires. In this example, the maximum total heat drain capacity has been designed for 105 KW, which corresponds with a capacity of quenching of maximum 1500 kg of steel per hour in the patenting operation, and this has to be taken into account when choosing the number of wires with a given diameter. In such choice it is also necessary to take into account the necessary dwelling time of the wire in the first chamber, which is inversely proportional to the diameter of the wire. Accordingly, for wires of 2 mm diameter, this system will have a traveling speed of about 0,475 m/sec, and will be capable to treat up to 30 parallel wires at a maximum heat drain capacity of 105 KW. In this example, the system for guiding the wire through the fluidized bed, has been designed for guiding 30 wires of a diameter of 1 to 6 mm. In the case of larger diameters, less than 30 wires shall then be treated in parallel, in order not to exceed the maximum designed production capacity.

As a carrying gas for the fluidized bed 13 of the first chamber, the exhaust gas is taken of a furnace (not shown), that is located immediately upstream, with respect to the wire movement, before the fluidized bed installation of FIG. 1, which furnace is traversed by the same wires in order to be brought at an austenitizing temperature (between 900° and 1050° C.). In this furnace, combustion takes place with a shortage of oxygen, so that this carrying gas cannot provoke any oxidation of the wire. The exhaust gas is sucked by a ventilator 17 via a heat exchanger 18, and is further blown through to the first fluidized bed 3. In the heat exchanger 18, the exhaust gas is cooled down to about 150° C., and this gas is then blown in, via inlet 11 of the fluidized bed 3, in the plenum chamber 19 subjacent to fluidized bed 13. The plenum chamber 19 is separated from the fluidized bed 13 by the bottom 20 of fluidized bed chamber 3, and this bottom is provided with a multiplicity of blowing orifices 21, through which the carrying gas is blown, from the plenum chamber into the fluidized bed chamber, in a way, uniformly distributed over the bottom surface, and at a temperature of about 120° C. As a bottom with blowing orifices, those as explained in U.S. Pat. No. 4.813.653 are used.

In the fluidized bed, an equally distributed carrying gas stream is created in the upward direction, whereby the bed is fluidized, and the carrying gas that emerges at the top is then evacuated from the fluidized bed chamber via outlet opening 12. For wires of 2 mm, the outlet temperature is regulated to about 420° C., and this corresponds to a heat drain of about 12 KW. This comparatively low portion, taken by the primary cooling by the carrying gas (less than 15 KW per $m^2$ bed surface,), of the total cooling capacity is possible in this quenching step of the patenting operation, because the largest portion of the heat is removed via the secondary cooling.

Figure 2:
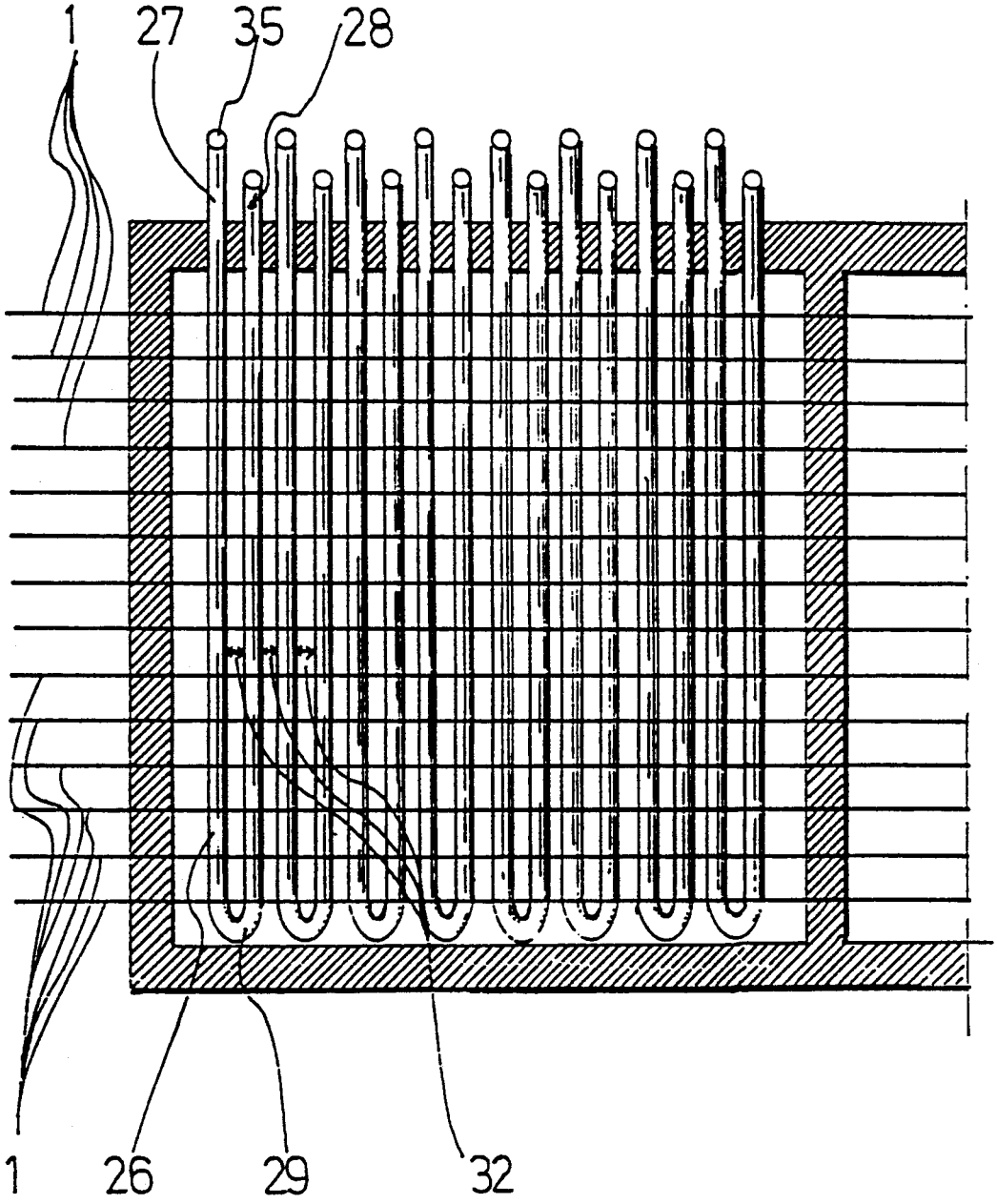
FIG. 2 is a top view of the first fluidized bed chamber of FIG. 1.

The secondary cooling occurs by means of air, that is sucked from the surrounding atmosphere by a ventilator 22 via inlet 36, and that is further blown, via flow regulator 23, through a system of pipes 24 towards an outlet 25. The pipe system consists in this case of eight pipes 26 having an U-form, that are immersed in oblique position in the bed, and that are connected together in parallel. In FIG. 1, the plane of each U, and also both legs of the U, are perpendicular to the plane of the drawing, so that the U-form can not be seen. In the top view of FIG. 2 however, the U-form can be seen, although it is not located in the (horizontal) plane of the drawing. Each one of the eight U's comprises a straight and horizontally running entrance leg 27 and exit leg 28, that are connected together into a U-form by means of an elbow 29. All entrance legs 27 lie in the same horizontal plane 30 (FIG. 1), and all exit legs 28 in another subjacent plane 31. The diameter of the pipes is not so large, and the pipe system not so compact, as to prevent to look through the pipe system in vertical projection (FIG. 2). Between the different legs, an interspace 32 is always visible in vertical projection. In this way, the fluidization through this comparatively compact pipe system is not jeopardized.

For convector systems in general, having another configuration, in order to obtain good fluidization, care shall be taken that the cooling elements be not concentrated in a single horizontal plane, but that they should rather be distributed over two or more horizontal planes. It has further to be seen that the interspaces between the cooling elements can be reached as well as possible by the vertical gas stream, and that the resistance against this stream be distributed as equally as possible over the bed surface. This is obtained when care is taken, on one hand, that the cooling elements of one plane, when observed in vertical projection, only cover those of any other plane to an extent as small as possible, or preferably not at all, and that, on the other hand, the vertical projection of all cooling elements of the convector, do not cover the whole surface of the fluidized bed, but only for 50 to 80%, in other words, that the convector, in vertical projection, still shows interstices and is still transparent, in vertical view.

In the drawings, the entrance and exit legs 27 respectively 28, are connected in parallel to an entrance and exit tube, 33 respectively 34, via a number of vertically running connecting tubes 35 outside the casing. The entrance and exit legs must not necessarily be perpendicular to the traveling direction of the wires, but may cross that direction otherwise than perpendicularly, although the perpendicular crossing is preferred.

The flow regulator 23 is steered by a control system 37 for the control of the temperature of the fluidized bed around the wires, in order to keep this temperature at a constant value, despite all disturbances, such as fluctuations of the heat drain by the carrying gas, or of the heat input via the wire (mainly speed changes). As usual, such a regulating system comprises a feeling device (not shown) of the temperature, located in the fluidized bed in the proximity of the wires, and that sends its output signal to a comparator that measures the deviation of the measured value from the desired value. This deviation is then transformed, in an analog or digital way, into a correction signal (having, as usual, a proportional, differential and integral portion), and this correction signal acts on flow regulator 23 so as to increase or to reduce the cooling air flow to the extent as wanted.

The cooling pipes are made of steel and have an outer diameter of 4.8 cm. This gives a cooling surface of about 2 $m^2$ per square meter of bed surface. In normal operation with wires of 2 mm diameter traveling through the bed at 0.475 m/sec, the exit temperature of the air is then about 200° C. at a nominal flow of 2000 $Nm^3$ per hour, and this corresponds to a nominal heat-drain of about 93 KW, taking into account the heating-up of the air in the sucking ventilator. This is a heat drain capacity of 7.75 times the heat drain capacity of the primary cooling system. The advantage of the invention can however sufficiently be exploited when the cooling surface of the secondary circuit is larger than 0.4 $m^2$ per square meter of bed surface and when the heat drain by the secondary circuit is larger than three times the heat drain of the primary circuit.

The second, third and fourth fluidized bed chamber, respectively 4 to 6, have each, in this example of embodiment, an own inlet for the carrying gas. As these chambers serve for keeping the wires at the temperature of sorbitic transformation, the carrying gas shall be blown in at this temperature (between 530° C. and 570° C.). This temperature can be different from one chamber to the other. This carrying gas shall preferably come from the same austenitizing furnace, but has to be cooled down to a lesser extent.

The invention is not limited to quenching in the patenting operation, but can be applied in any installation with one or more fluidized bed chambers, in which each chamber has its own function in an overall heat treatment programmed that the steel wires have to undergo, and in which one of these chambers serve for quenching from a higher temperature to a lower one, which has however not to be below about 250° C., in order to avoid condensation of moistness in the carrying gas.

We claim:

1. An apparatus for continuously quenching steel wires to a temperature of no less than 250° C., comprising:

(A) a fluidized bed having a surface;

(B) an air source; and (C) a convection cooler using a stream of air as a cooling fluid, said convection cooler having an outlet and having an inlet connected to said air source, said convection cooler thermally contacting said fluidized bed and having a cooling surface of at least 0.4 $m^2$ per square meter of said fluidized bed surface, the specific heat flow H of the air stream being variable, wherein H is the air flow multiplied by the specific heat of the air flowing through the convection cooler, said convection cooler further having a regulating system for maintaining the temperature of said fluidized bed at a constant value by varying said specific heat air flow.

2. The apparatus according to claim 1, wherein the output flow of said air source is variable and wherein said regulating system generates an output signal which controls said air source.

3. The apparatus according to claim 2, wherein said inlet of said convention cooler comprises an atomizer of liquid which injects a spray of liquid into a passageway of said air stream from said air source towards said convection cooler, said atomizer having a variable output flow which is controlled by said output signal of said regulating system.

4. The apparatus according to claim 1, wherein said convection cooler comprises a plurality of cooling elements distributed over more than one horizontal plane, a vertical projection of the cooling elements of one of said planes not covering the vertical projection of the cooling elements of any other of said planes and the vertical projections of all of said cooling elements covering a maximum of 80% of said surface of said fluidized bed.

5. The apparatus according to claim 4, wherein each of said cooling elements comprises a cooling pipe having legs which run horizontally through said fluidized bed in a direction crossing the axial direction through which he wires are drawn and which are joined to form a U-shaped cooling pipe, wherein one of said legs is located in an upper horizontal plane of said fluidized bed and the other of said legs is locate din a lower horizontal plane with a vertical interstice being formed between said legs, said legs being connected in parallel between said inlet and said outlet.

6. The apparatus according to claim 1, further comprising:

a casing which separates the atmosphere in and above said fluidized bed from the external atmosphere, a furnace, a cooling device connected to an outlet of said furnace, and an inlet for carrying gas, said inlet for carrying gas connecting said cooling device to said casing.

7. An installation for the continuous patenting of a row of steel wires running side by side in parallel with one another in the axial direction of said wires, said installation comprising:

(A) a furnace for austenitizing said wires; and (B) a fluidized bed installation for quenching said wires and for effecting a sorbitic transformation of said wires, fluidized bed installation comprising:

(i) a plurality of contiguous fluidized bed chambers arranged in series, the first one of said fluidized bed chambers comprising a fluidized bed having a surface, (ii) an air source; and (iii) a convection cooler using a stream of air as a cooling fluid, said convection cooler having an outlet and having an inlet connected to said air source, said convection cooler thermally contacting said fluidized bed and having a cooling surface of at least 0.4 $m^2$ per square meter of said fluidized bed surface, the specific heat flow H of the air stream being variable, wherein H is the air flow multiplied by the specific heat of the air flowing through the convection cooler, said convection cooler further having a regulating system for maintaining the temperature of said fluidized bed at a constant value by varying said specific heat air flow.

8. A process for continuously quenching steel wires to a temperature of no less than 250° C., said process comprising the steps of:

(A) guiding said wires through a bed which is fluidized by a carrying gas and which has a convention cooler immersed therein;

(B) sending an air stream through said convection cooler which drains away at least three times the heat drained away by said carrying gas; and (C) maintaining the temperature of said fluidized bed constant by controlling the specific heat flow H of cooling air flowing through said fluidized bed.

9. A process according to claim 8, wherein said step of maintaining said temperature constant comprises the step of controlling the specific heat flow by controlling the flow rate of air through said convection cooler.

10. A process according to claim 8, further comprising the step of injecting atomized liquid into said air stream, and wherein said step of maintaining said temperature constant comprises the step of controlling the specific heat flow by controlling the quantity of injected atomized liquid.

11. A process according to claim 8, further comprising the steps of maintaining and fluidized bed under a non-oxidizing atmosphere and supplying said carrying gas to said fluidized bed from a combustion device in which combustion occurs with a shortage of oxygen.

12. A process for continuously patenting steel wires comprising the steps of:

(A) passing said wires through an austenitizing furnace; and then (B) quenching said wires in a fluidized bed wherein said wires undergo a sorbitic transformation, said quenching step comprising the steps of (i) fluidizing a bed with a carrying gas comprising exhaust gas taken form a furnace, said bed having a convection cooler immersed therein, (ii) guiding said wires through said fluidized bed, (iii) sending an air stream through said convection cooler which drains away at least three times the heat drained away by said carrying gas, and (iv) maintaining the temperature of said fluidized bed constant by controlling the specific heat flow H of cooling air flowing through said fluidized bed.

13. A process according to claim 12, wherein said step (i) drains away heat from said fluidized bed at a rate of not more than 15 KW per square meter of the surface of said fluidized bed, and wherein said step (iii) drains away heat from said fluidized bed at a rate of at least 50 KW per square meter of the surface of said fluidized bed.

14. A process according to claim 8, wherein said step of sending an air stream through said convection cooler comprises the step of sending an air stream through a convection cooler providing a cooling surface of at least 0.4 $m^2$ per square meter of the surface of said fluidized bed.

15. A process according to claim 8, wherein said step of sending an air stream through said convection cooler comprises the step of drawing said air stream into said convection cooler from an inlet of said convection cooler.

16. A process according to claim 8, wherein said step of sending an air stream through said convection cooler comprises the step of sending an air stream through a convection cooler providing a cooling surface of at least 0.4 $m^2$ per square meter of the surface of said fluidized bed.

17. A process according to claim 8, wherein said step of sending an air stream through said convection cooler comprises the step of drawing said air stream into said convection cooler from an inlet of said convection cooler.

* * * * *